United States Patent [19]

Daguano

[11] Patent Number: 4,601,636

[45] Date of Patent: Jul. 22, 1986

[54] MECHANICAL CARRIER

[76] Inventor: José P. Daguano, Alameda Guaramomis, 929 - apt. 11, São Paulo, Brazil, 04076

[21] Appl. No.: 629,730

[22] PCT Filed: Jun. 14, 1983

[86] PCT No.: PCT/BR83/00005

§ 371 Date: Jul. 6, 1984

§ 102(e) Date: Jul. 6, 1984

[87] PCT Pub. No.: WO84/02120

PCT Pub. Date: Jun. 7, 1984

[30] Foreign Application Priority Data

Nov. 22, 1982 [BR] Brazil ..... 8206737

[51] Int. Cl.[4] ..... B66C 1/00

[52] U.S. Cl. ..... 414/733; 414/917

[58] Field of Search ..... 414/728, 742, 749, 750, 414/751, 753, 733, 680, DIG. 917

[56] References Cited

U.S. PATENT DOCUMENTS 1,766,573 6/1930 Westin .
2,653,502 9/1953 Meyer et al. .
2,811,266 10/1957 Udal .
3,061,118 10/1962 Halberstadt .
3,124,257 3/1965 Price et al. .
3,127,026 3/1964 Blatt .
3,209,922 10/1965 Melvin .
3,790,001 2/1974 Schnell ..... 414/680
4,516,699 5/1985 Burton et al. ..... 414/733 X

*Primary Examiner*—Joseph E. Valenza
*Assistant Examiner*—Darrell G. Dayoan
*Attorney, Agent, or Firm*—Cushman, Darby & Cushman

[57] ABSTRACT

Patent of Invention for a mechanical carrier, comprising a supporting chassis (1), a movable body, (3) in internal position, driven by a pneumatic cylinder (4), having a first jointed set (5), comprising a pair of cross arms, parallel to each other and jointed in a triangular part (8), fixed to a chain (9), which fits to the gear (10) mounted on the movable body (3); said triangular part (8) is coupled to the lower arm (7) and a stem (12) within a jacket (13), the positioning of which is determined by the supports (14) and (15) fixed to the jacket (13) and to the vertex of the triangular part (8), while the support (15) is jointed to the end of the stem (12), by means of a horizontal part (16), which can have coupled thereto a grasping device (24).

2 Claims, 3 Drawing Figures

MECHANICAL CARRIER

This Patent of Invention refers to a mechanical carrier, or more particularly, to a part transference or transportation device, mechanically jointed, upon driving of pneumatic pistons, hand or automatically control by means of a control panel, in a way that the grasping system can be displaced pursuant to vertical and horizontal way, which are driven independently or jointly, so as to permit the removal of a part from one place to another. Therefore, this mechanical carrier is presented as an automatic and/or hand controlled device, to used in mass or normal production, in which various applications are feasible, mainly in metalworking shop, for extraction or automatic feed of parts for the interior of metal stamped parts in any kind of pressing machines, as well as for transferences of parts from one machine to another, performing different operations. As last, this mechanical carrier can be used at any production site, either for mass or normal production, wherein an equipment to perform the moving of parts from one place to another, mainly between machines, is needed.

In order to provide a better understanding of this patent of Invention, references will be made to the attached drawings, wherein FIG. 1 is a front view;

Figure 1:
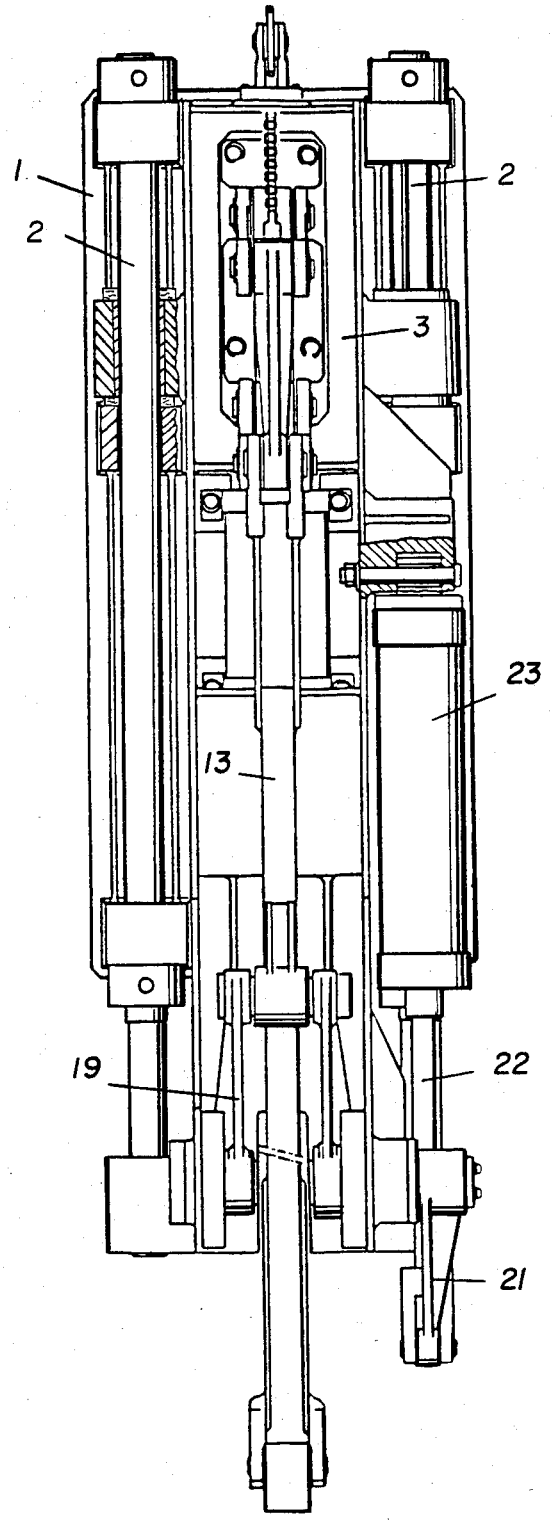
Figure 2:
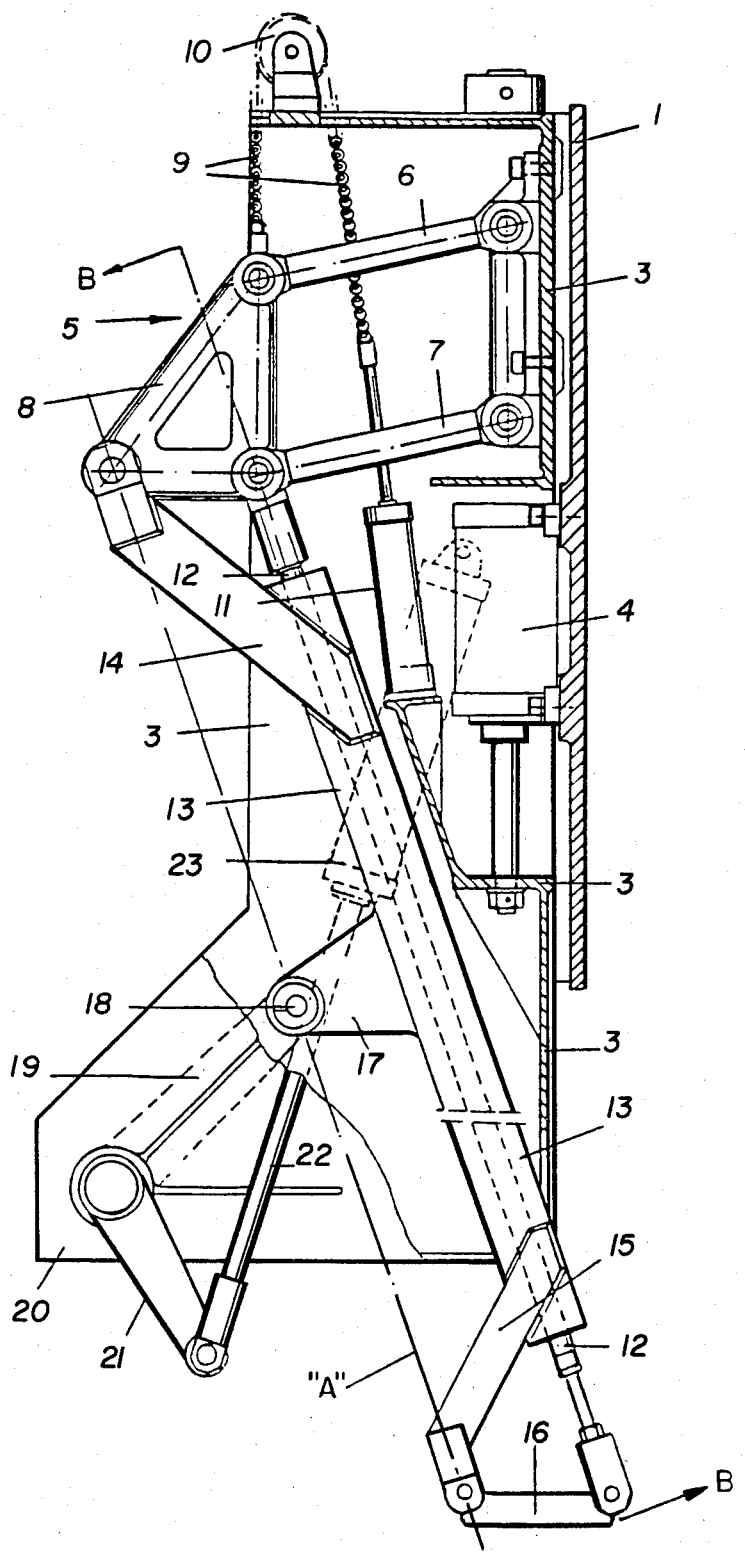
FIG. 2 is a side view, under partial cut; finally

This Patent of Invention refers to a mechanical carrier (see FIGS. 1 and 2) comprising a chassis/base (1), in vertical position, which provides the fastening of the set to the machine or equipment in which it shall be used, said chassis presenting side guides (2), wherein a movable internal body (3), is moved, driven by a pneumatic cylinder (4), the body of which is fastened in parallel to the internal face of the chassis/base (1); in the upper part of the said movable body (3) is located a first linkage means (5) comprising a pair of cross arms, parallel to each other, one of them in upper position (6), and the other in a lower one (7), both with one of the ends jointly mounted to the movable body (3), while the opposite ends of the same are also jointly fixed to a triangular part (8), the upper vertex has also fixed thereto the end of a chain (9), which, in turn, is developed upwards, thus fitting a gear (10) mounted at the upper part of the movable body (3), being afterwards developed downward, so as to have an end linked to the piston of a cylinder (11), duly fixed to the movable body (3).

In one of the lower vertex of the triangular part (8), or, more precisely, in its right angle vertex, there is jointly fixed, together with a corresponding end of the lower arm (7), the upper end of a cylindrical stem (12) which develops downward and within a tubular jacket (13), the positioning of which is determined by an upper support (14) and a lower support (15), the upper support (14) having an end welded to the corresponding end of the jacket (13), while its other end is jointly fixed to the free vertex of the triangular part (8), while the lower support (15) is geometrically fixed in a way that its free end can be jointly interconnected to the lower end of the stem (12), through a horizontal element (16), and also to have the jointed ends of said supports (14) and (15) remaining on the center line (A) paralel to the longitudinal center line (B) of the tubular jacket (13), said paralel condition being maintained under any circumstances.

A bearing (17) leaves the medium part of the tubular jacket (13), in the free end of which there is a cross axle (18), which is orthogonally centered on line (A), so permiting that, at the free ends of said axle, the upper ends of the side arms (19) be jointly coupled, the lower ends being fixed to axles, revolvingly mounted at the side parts (20) of the movable body (3), wherein one of said axles is extended outward enough to receive a last radial arm (21), at the free end of which it is coupled the terminal of a piston (22) of a pneumatic piston (23), conveniently mounted at the outer part of the movable chassis (3).

Figure 3:
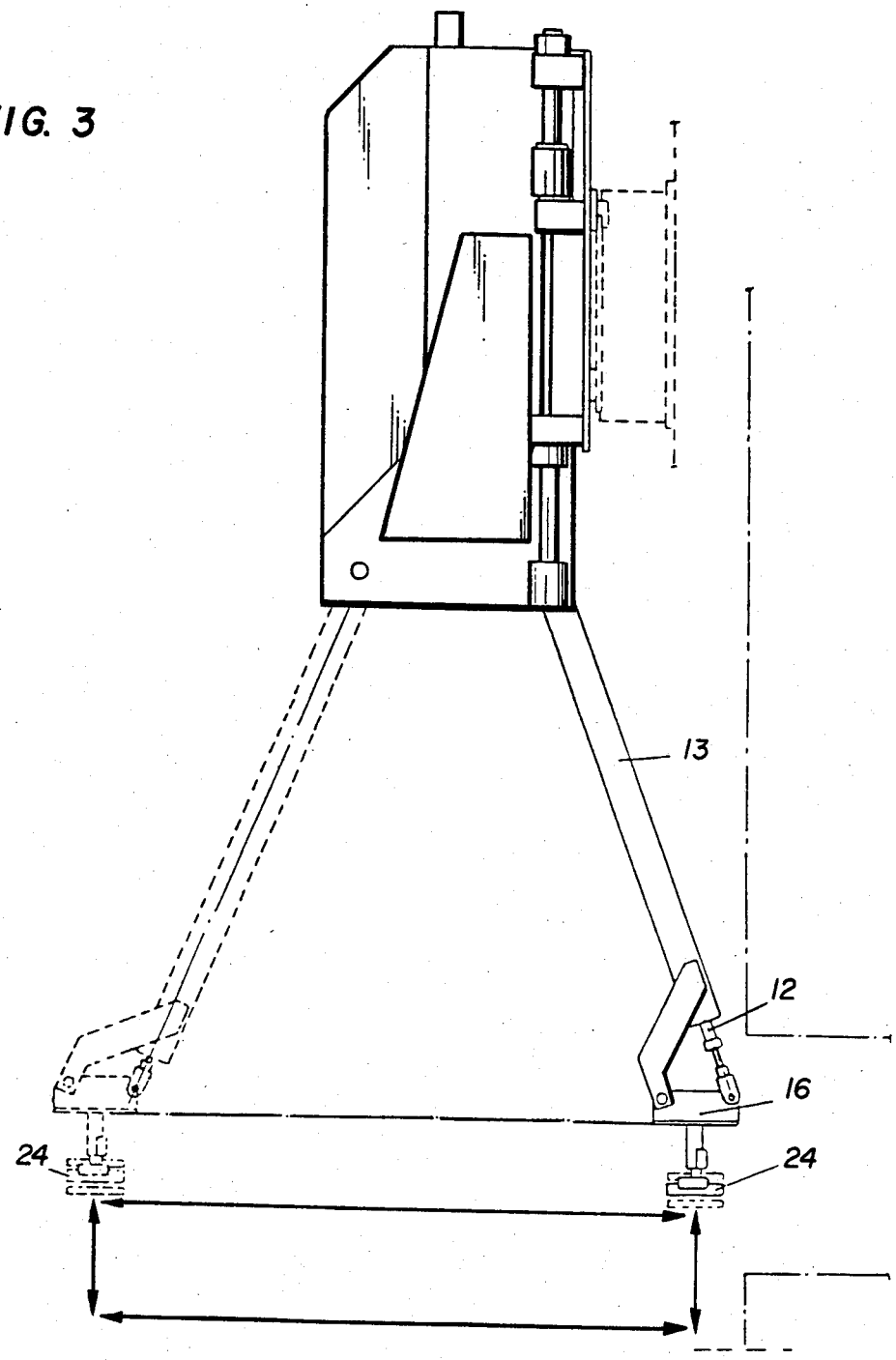
FIG. 3 is a schematic side view, ilustrating the functioning of this mechanical carrier.

According to the illustration of FIG. 3, any grasping accessory (24) can be coupled to the horizontal element (16), the construction varieties occuring as a function of the part to be transported, including even vertical, horizontal, rotary and angular regulations.

The present mechanical carrier comprises several coupled sets, the function of which is to transform the straight movements of pneumatic cylinders (4) and (22) at the moment they are driven by means of a central control, comprising a control panel and a series of electrical and electronic components (not indicated in the drawings), said movements, being already transformed, transmited to the carrying device (24), in such a way that it can be displaced by following a motion pre-programmed at said central control system, said motion being such that, among many others, it is just like the type schematically represented at the lower part of FIG. 3.

On the other hand, upward/downward vertical movements are effected by means of the pneumatic cylinder (4), internally placed, while the horizontal movements are effected by the pneumatic cylinder (23), logically together with the jointed parts of the linkage means (5) and the jointed parts of the stem (12, 13 and 16).

What is claimed is:

1. Mechanical carrier, comprising a chassis/base (1) in vertical position, responsible for the fastening of the set to the machine or equipment wherein it shall be used, said chassis featuring side guides (2), in which a movable body is vertically moved (3), in internal position, driven by a pneumatic cylinder (4), the body of which is fixed in paralel to the internal face of the chassis/base (1), the upper part of said movable body (3) having a first linkage means (5), comprising a pair of cross arms, paralel to each other, one of them in upper position (6) and the other one in lower position (7), both of them with one of their ends jointly mounted to the movable body (3), while the opposite ends thereof are also jointly fixed to a triangular part (8), the upper vertex of which has also fixed the end of a chain (9), which, in turn, develops upwards, so as to meet a gear (10) mounted at the upper part of the movable body (3), after which it develops downward so as to have the end coupled to the piston of a cylinder (11), conveniently fastened to the movable body (3); in one of the lower vertexes of the triangular part (8), or more precisely, at its straight angle vertex, there is jointly fixed the upper end of a cylindrical stem (12), together with the corresponding end of the lower arm (7), developing downward and within a tubular jacket (13), the positioning of which is determined by an upper support (14) and a lower support (15), said upper support (14) having an end fixed to the corresponding end of the jacket (13), while its other end is jointly fixed to the free vertex of the triangular part (8), while the lower support (15) is geometrically fixed in a way that its free end can be jointly interconnected to the lower end of the stem (12), by means of a horizontal part (16), and also in a way that the jointed ends of said supports (14) and (15) stay on a center line (A) paralel to the longitudinal center line (B) of the tubular jacket (13), said paralel condition to be maintained under any circumstance; a bearing (17) comes out from the medium part of the tubular jacket (13), at the free end of which there is a cross axle (18), orthogonally centered on the line (A), the free ends of which having jointly coupled the upper ends of the side arms (19), the lower ends of which being fixed to axles revolvingly mounted to the side parts (20) of the movable body (3), wherein one of said axles is extended outward enough to receive a last radial arm (21), at the free end of which the terminal of a piston (22) of a pneumatic piston (23) is coupled, said pneumatic piston being conveniently mounted at the outer part of the movable chassis (3).

2. Mechanical carrier, pursuant to claim 1, wherein the horizontal element (16) can have coupled a grasping device (24), the construction varieties of which shall arise as a function of the part to be transported, including with vertical, horizontal, rotary and angular regulations.

* * * * *